US007183730B2

(12) United States Patent
Gutierrez Vazquez et al.

(10) Patent No.: US 7,183,730 B2
(45) Date of Patent: Feb. 27, 2007

(54) METHOD AND APPARATUS FOR RECEIVING AND MANIPULATING SHEET MATERIAL

(75) Inventors: Hernan I. Gutierrez Vazquez, Guadalajara Jalisco (MX); Laurent A. Regimbal, Round Rock, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 165 days.

(21) Appl. No.: 10/438,399

(22) Filed: May 15, 2003

(65) Prior Publication Data

US 2004/0245710 A1 Dec. 9, 2004

(51) Int. Cl.
*H02P 1/18* (2006.01)

(52) U.S. Cl. ..... 318/254; 318/439; 318/138; 318/602; 388/800; 388/815; 271/184; 271/186; 271/270

(58) Field of Classification Search ..... 318/609, 318/610, 254, 439, 138, 632, 638, 602; 388/800, 388/806, 815, 821–823; 271/184, 186, 270
See application file for complete search history.

(56) References Cited

U.S. PATENT DOCUMENTS

| | | | | |
|---|---|---|---|---|
| 3,917,142 | A * | 11/1975 | Guarderas | 226/38 |
| 4,591,774 | A * | 5/1986 | Ferris et al. | 318/696 |
| 4,969,641 | A * | 11/1990 | Fukushima et al. | 271/187 |
| 5,212,458 | A * | 5/1993 | Fitzpatrick et al. | 330/288 |
| 5,298,841 | A * | 3/1994 | Katayama et al. | 318/268 |
| 6,619,778 | B2 * | 9/2003 | Igarashi | 347/19 |
| 6,805,342 | B2 * | 10/2004 | Takahara et al. | 271/19 |

FOREIGN PATENT DOCUMENTS

EP 1201445 A2 5/2002

* cited by examiner

*Primary Examiner*—Rina Duda

(57) ABSTRACT

Disclosed are systems and methods for receiving and manipulating the travel of a sheet material, such as paper, from a device such as an imaging device. One embodiment of a system can be implemented as a system for handling a sheet material including a flipper device that has a shaft for accelerating a sheet material, such as paper. The flipper device also has a drive system for causing the shaft to rotate. A drive system is also provided that has a direct current motor configured to drive the shaft.

27 Claims, 5 Drawing Sheets

METHOD AND APPARATUS FOR RECEIVING AND MANIPULATING SHEET MATERIAL

BACKGROUND

Imaging systems, such as printers, facsimile machines, and copiers, are very common today in the workplace and in homes. In the current business environment, imaging systems have become crucial to every day business activities. As such, the reliability and smooth operation of imaging systems is of paramount importance. It is, therefore, important to design imaging systems so that downtime and work interruptions are minimized. This can be a daunting challenge, given the complexity of systems in which sheet material must be received, moved through the imaging process, and distributed from the imaging system in a matter of seconds.

Many imaging systems have not only an imaging device, but are also equipped with media handling devices. Media handling devices perform such tasks as collating, organizing, stacking, and stapling media, or sheet material, as it is output from the imaging device. This is a very important function when handling large volumes of sheet material (e.g. paper products or other media). These devices are commonly physically joined to the imaging system.

One common function of a media handling device is to "flip" sheet material as it exits the imaging system. That is, the leading edge of a sheet material becomes the trailing edge as the media handling device "flips" a sheet material from face-up to face-down, or vice-versa. In most media handling devices this flipping operation is useful for accumulating print jobs properly in a "bin module" in order to collate and staple the sheet material. This flipping function is usually accomplished by a flipper module within the media handling device.

The flipper module generally begins its operation by accelerating a piece of sheet material as it exits the imaging system in order to generate a gap between adjacent pieces of sheet material. This gap gives the flipper module time to flip the accelerated sheet. This acceleration is usually accomplished by a shaft that exerts a force on a piece of sheet material through frictional rollers. The shaft and the rollers are usually driven by a stepper motor. While the use of a stepper motor in a flipper module is somewhat effective at accelerating a piece of sheet material to be "flipped," there are several drawbacks to this approach.

It must be understood that it is important in media handling devices to control the speed of the sheet material and the torque placed upon the sheet material. If an excessive amount of torque is placed on a sheet material, the material may become damaged. Furthermore, excessive torque may lead to the generation of undesirable acoustic noise, depending on the weight of the sheet material. On the other hand, if the speed of the sheet material is not controlled properly, the leading edge of one sheet may run into the trailing edge of a preceding sheet. In either situation, there will likely be what is commonly known as a "media jam" of the paper handling device.

Speed and torque control is especially important in flipping operations. As noted above, a sheet entering the flipper module is typically first accelerated so as to separate it from a succeeding piece of sheet material. This acceleration gives the first sheet of material time to be flipped by the flipper module before the succeeding sheet of material enters the flipper module.

With a stepper motor, the motor, with feedback from an encoder system, is required to self-adjust, or perform a calibration routine for every sheet of material that enters the flipper module. This self-adjust feature is usually necessary to achieve proper torque control over the sheet. In a typical paper handling device, the self calibration routine requires approximately 150 milliseconds for every sheet, and about 1 second for a full calibration, which must be accomplished every specified number of sheets. The time spent in this calibration routine does not allow the paper handling device flipper module to receive another sheet immediately, simply because of the time required to run the calibration routine.

There are also characteristics of stepper motors, generally, that make stepper motors less than the most desirable solution for the driving motor in a flipper module. For example, stepper motors tend to cause vibrations which resonate with the paper handling device's frame. Additionally, if the media handling device ever stops, starting the stepper motor with paper in the rollers is very difficult. Such an occurrence is known as a "stepper stall" and is due generally to the non-linear nature of stepper motors.

Thus, a heretofore-unaddressed need exists in the industry to address the aforementioned deficiencies and inadequacies in paper handling devices.

SUMMARY OF THE DISCLOSURE

Disclosed are systems and methods for receiving and manipulating the travel of a sheet material, such as paper, from a device such as an imaging device.

In one embodiment, a system for handling a sheet material includes a flipper device that has a shaft for accelerating a sheet material, such as paper, and a drive system for causing the shaft to rotate. The drive system is provided such that has a direct current motor configured to drive the shaft.

In one embodiment a method for controlling or changing the speed of travel of a sheet material includes providing a direct current motor connected to an urging shaft; receiving a sheet material at the urging shaft; and accelerating the sheet material through contact with the urging shaft by an amount corresponding to a speed of the direct current motor.

BRIEF DESCRIPTION OF THE DRAWINGS

The components in the following drawings are not necessarily to scale. In the drawings, like reference numerals designate corresponding parts throughout the several views.

DETAILED DESCRIPTION

Disclosed are media handling devices, and more particularly, flipper modules for media handling devices.

Figure 1A:
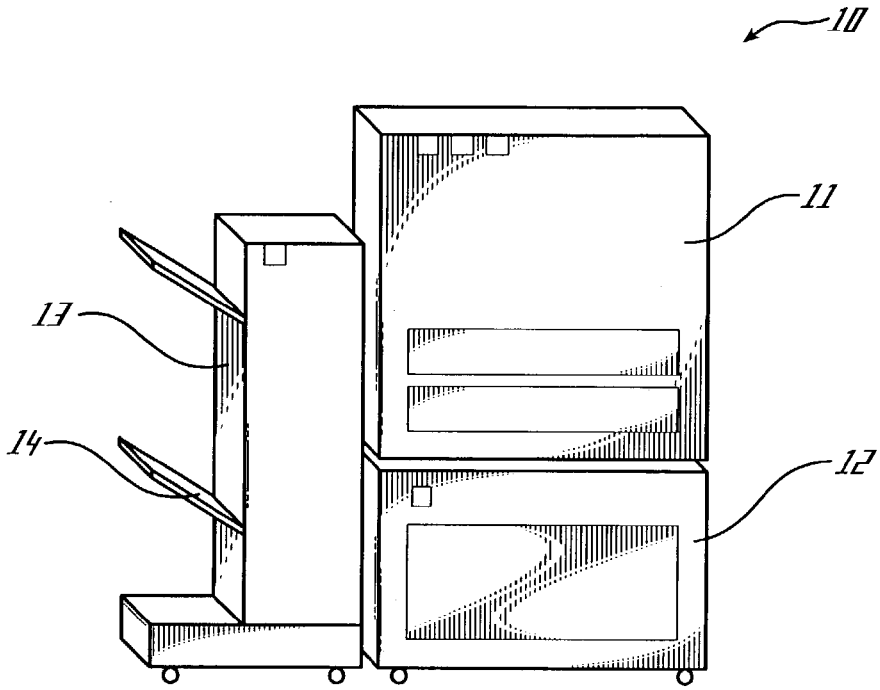
FIG. 1A is a side view of an embodiment of an imaging device with an attached media handling device for manipulating print media that is produced from the imaging device.

FIG. 1A depicts an example system environment 10 for the disclosed paper handling devices. Generally, the system 10 comprises an imaging device 11, such as a printer, having a sheet material input unit 12. The imaging device 11 could be any number of printer types, such as for a computer system or a network of computers. Additionally, the system environment 10 could also comprise another type of imaging device, such as, for example, a facsimile machine, a scanner, or a copier. The particular imaging device 111 of the referred system environment 10 is not important to the present invention.

Additionally, the particular sheet material used by the imaging device is also not critical to the present invention. The sheet material can comprise, for example, paper material of various densities, sizes, types, or even transparency material or recycled material.

Attached to the imaging device 11 is a media handling device 13. The media handling device 13 receives sheet material, such as paper, from the imaging device 11, arranges the sheet material in a desired fashion, and places the sheet material on a series of output bins 14.

Figure 1B:
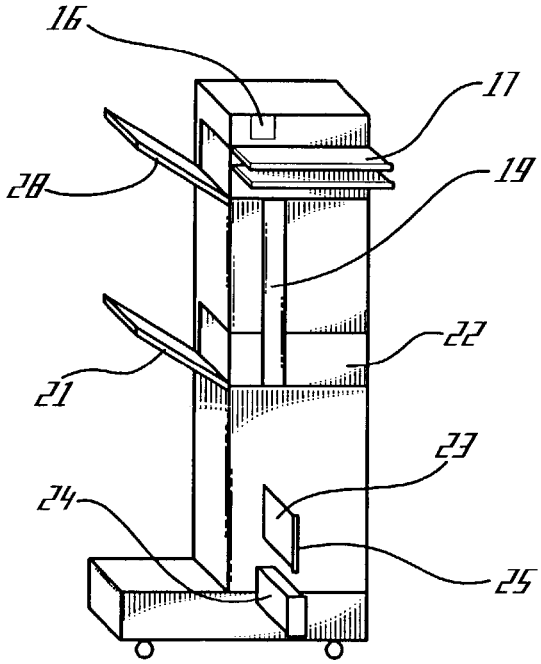
FIG. 1B is a side view of an embodiment of the paper handling device of FIG. 1A.

FIG. 1B more specifically depicts the elements of the media handling device 13 of the disclosed environment 10. Such devices typically have a light emitting diode (LED) indicator 16 that indicates when the media handling device 13 is operational. When operational, sheet material is moved from an exit port (not shown) on the imaging device 11 into the media handling device 13. The first item the sheet material usually encounters in the media handling device 13 is a flipper module 17 incorporated into the media handling device 13. If a user has configured the media handling device 13 to produce the sheet material face-up, the flipper module 17 does not operate on the sheet material and simply passes the material through the flipper module 17 and into a face-up output bin 18.

However, if the user has selected to produce the sheet material in face-down fashion, the flipper module 17 "flips" the sheet material and passes the material along to and through a paper path 19 internal to the media handling device 13. The sheets of material may also be further operated upon by an offset module 22 before being produced in a face-down output bin 21.

The operation of the media handling device 13 is typically managed by a controller 23 which has various service LED indicators 25. This controller 23 may be a microcomputer, a discrete logic circuit(s) having logic gates for implementing logic functions upon data signals, an application specific integrated circuit (ASIC) having appropriate combinational logic gates, a programmable gate array(s) (PGA), a field programmable gate array (FPGA), or other similar device. However, the controller 23 is typically a logic device with some analog circuitry implanted on a card.

The media handling device 13 is supplied power through a power supply unit 24. The power supply unit 24 typically interfaces to a standard AC power outlet though a power cord (not shown). The preferred power supply unit 24 performs any necessary power conversion, amplification, and/or distribution for the media handling device 13.

As noted previously, the particular media handling device 13 of the example environment 10, described above, is not important to the specifics of the present invention. Indeed, the flipper module 17 may have application in many other types of paper handling devices or systems. For example, the flipper module 17 may be incorporated into the imaging system itself. Or, the flipper module 17 could be used in any device that transports or otherwise controls the movement of sheet material.

A typical flipper module includes a receiving portion for receiving sheet material and accelerating the sheet material to an appropriate speed. As noted above, the sheet material is accelerated so as to create a "gap" between a trailing edge of a first sheet and a leading edge of a second sheet following the first sheet. This "gap" gives the flipper module the time needed to "flip" the first sheet before the leading edge of the following sheet enters the flipper module.

Figure 2:
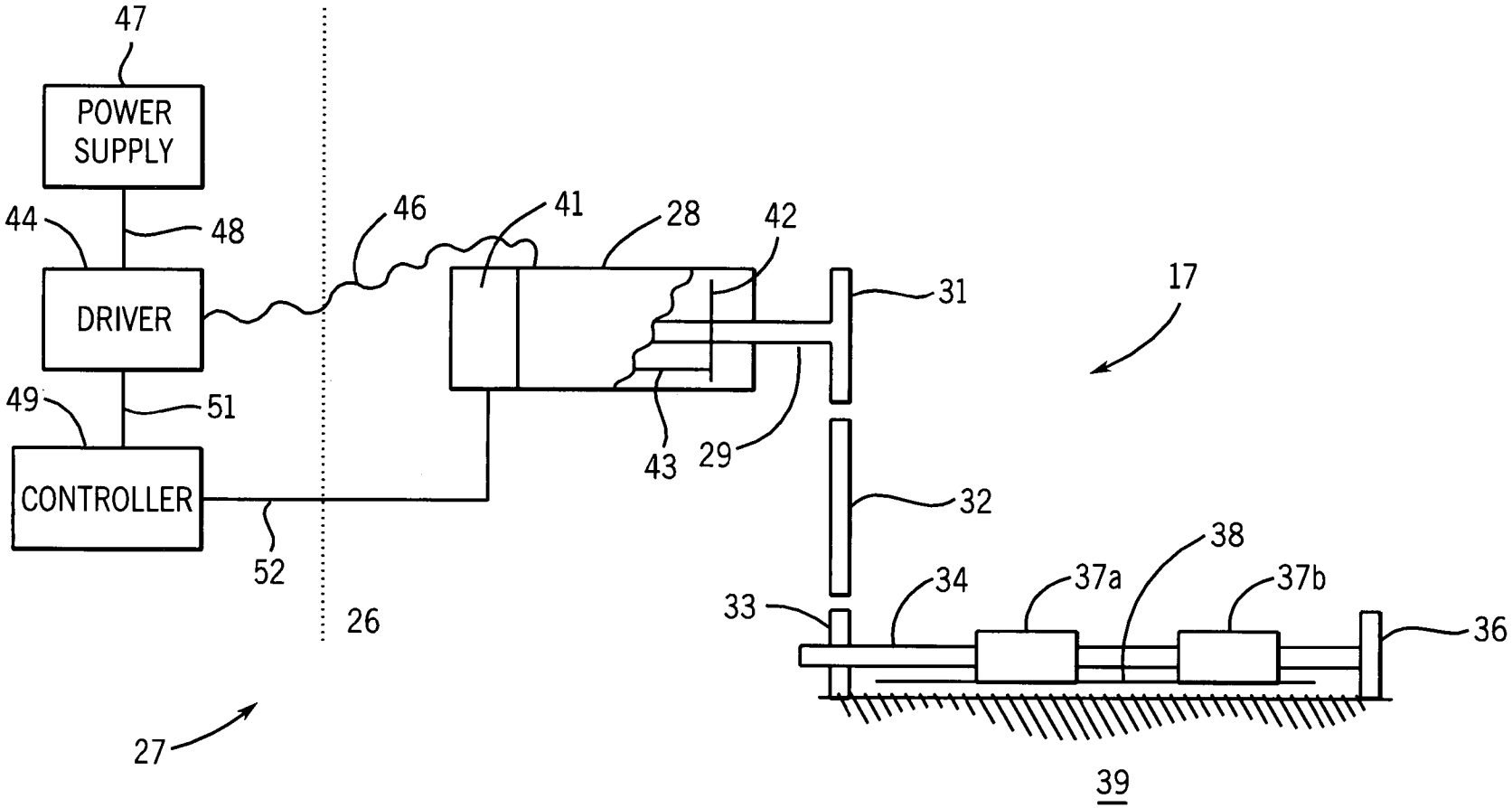
FIG. 2 is a schematic view of an embodiment of a flipper assembly of the media handling device of FIG. 1B.

FIG. 2 depicts a schematic view of an example receiving portion 27 for the flipper module 17. Although a flipper module 17 typically comprises other elements that actually "flip" the sheet material, the focus of the present discussion only deals with the receiving portion 27 of a flipper module 17. One having ordinary skill in the art would readily understand how the receiving portion 27 can be incorporated into a flipper module 17 having other conventional elements.

The receiving portion 27 comprises a direct current (DC)-motor 28 having a drive shaft 29 with a gear 31 at a distal end of the drive shaft 29. The DC motor 28 may comprise a brushless DC motor and causes the drive shaft 29 to rotate about its central axis, which, in turn, causes the gear 31 to also rotate about a center line of the gear 31. The DC motor 28 of the preferred embodiment 27 is a brushless DC motor. Brushless DC motors are readily available as an off-the-shelf item.

Although another type of DC motor may be used with the present invention, a brushless DC motor may be preferable due to the particular characteristics of a brushless DC motor. Brushless DC motors are typically three phase motors. Brushless DC motors have a synchronous motor with permanent magnets on the rotor and windings on the stator. For this reason, DC motors are occasionally referred to a "permanent magnet motors." Compared to induction motors, permanent magnet motors have a higher efficiency due to the elimination of magnetizing current and copper losses on the rotor. It is also easier to achieve high performance torque control with permanent magnet motors, compared to induction motors.

The particular size and power of the brushless DC motor 28 used depends on the application in which the flipper module 17 is used. In the embodiment shown in FIG. 1, the flipper module 17 is incorporated into a media handling device 13 attached to a computer imaging device 11. Thus, it can be determined from the exit speed of the individual printer and the particular time needed to flip a sheet, the amount of acceleration, and therefore torque, needed to apply to the sheet material. From the torque and speed needed, one can determine the specific DC motor to be used in a flipper module 17.

To give a specific example, it is generally known what the speed of sheet material will be at an exit port of the imaging device 11. For instance, if the imaging device 11 ejects sheet material from an exit port at a speed of approximately 147 mm/sec, one can determine from experimentation, to what speed the flipper module should accelerate a sheet material in order to prevent a second sheet from running into a first sheet while the first sheet is being flipped by the flipper module 17. It is preferred to compute this higher speed for the shortest sheet material to be used under continuous printing conditions.

Following the above example, one can determine that the flipper module should accelerate the sheet material to a speed of approximately 300 mm/sec. Of course, this is an arbitrarily selected valve only presented to provide a more specific example of the preferred computations. Based on the desired increase in speed, and the particular gear ratio of the flipper module 17, one can compute the torque and speed characteristics of the motor 28. For example, the preferred brushless DC motor may be a 24 volt (V) motor having at least 175 resolutions per minute (rpm) and at least 8 Newton millimeters (Nm) of torque.

The power necessary for a particular DC motor 28 to be used in a particular handling device 13 can also be determined. Continuing with the specific exemplary embodiment discussed above, the computation of the preferred motor characteristics are as follows. One knows that if the sheet material is to be moved at a speed of 300 millimeters per second (mm/sec), then a shaft 34 that drives the sheet material preferably rotates at a rate of 477.465 rpm, or 50 radians per second (rad/sec). Then, if the gear ratio is 1.167, one knows that the motor 28 preferably has a maximum speed of at least 58.335 rad/sec (or approximately 557 rpm). As for a minimum speed, in the exemplary environment 10, the imaging device 11 ejects sheet material at 147 mm/sec. Thus, the shaft 34 that drives the sheet material into the flipper module 17 preferably turns at a minimum of 233.958 rpm, or 24.5 rad/sec. If the gear ratio is still 1.167, one can determine that the motor 28 preferably has a minimum speed of 40.83 rad/sec (or approximately 390 rpm).

The characteristics of the preferred DC motor 28 may change due to a number of factors, including the particular gear ratio employed in the system. The specific example discussed above is non-limiting and only presented for purposes of more clearly explaining the computational procedures. One can readily size an appropriate brushless DC motor 28 for the system 27.

The drive gear 31 of the motor shaft 29 cooperates with an intermediate gear 32 which, in turn, cooperates with a flipper shaft gear 33. In the exemplary embodiment, the drive gear 31 has 18 teeth, the intermediate gear 32 has 31 teeth, and the flipper shaft gear 33 has 21 teeth. Of course, other embodiments of particular gear configurations can be used. In fact, in some configurations, no gears at all may be used. Also, the sizes of the various gears can be modified to yield a particular, preferred, gear ratio. In the exemplary embodiment, as noted above, the preferred gear ratio is: $(\omega_3/\omega_1=0.857$; and $\tau_3/\tau_1=1.167$. Often, the gear ratio may be modified in order to yield certain DC motor specifications so that a DC motor that is either inexpensive, or readily available, can be used in the flipper module 17.

In the exemplary embodiment 27, the flipper shaft gear 33 is attached to a first flipper shaft 34. The role of the first flipper shaft 34 is to receive a piece of sheet material 38 from a imaging device 11, or other device, to accelerate the sheet material 38, and to move the sheet material 38 away from the imaging device 11. The acceleration of the sheet material 38 is primarily accomplished by frictional force between the sheet material 38 and rollers 37*a*, 37*b*. Although other materials are possible, these rollers 37*a*, 37*b* typically comprise a semi-rigid rubber material. On the end of the first flipper shaft 34 opposing the flipper gear 33, is typically a support element 36. The role of the support element 36 is simply to support the shaft 34 and maintain a generally horizontal attitude of the shaft 34. The support element 36, while not required, may be designed to cause the rollers 37*a*, 37*b* to exert frictional force on the sheet material 38.

In the exemplary embodiment, the motor 28 is equipped with an optical encoder 41. The encoder 41 of the exemplary embodiment 27 is connected to a sensor 42 by a sensor line 43. The sensor 42 is positioned about the drive shaft 29 of the DC motor 28 so that that speed, in revolutions per time interval, of the shaft 29, and consequently, the motor 28, can be read by the sensor 42. This data is transferred to the encoder 41 by the sensor line 43. The encoder 41 receives this data and converts the data into a pulsing signal so that the number of pulses emitted by the encoder 41 reflects the speed of the motor 28.

In the exemplary embodiment 27, the encoder 41 passes the aforementioned pulse data on motor speed through a feedback line 52 to a flipper controller 49. The flipper controller 49 is the device of the exemplary embodiment 27 that monitors and adjusts the operation of the flipper module receiving portion 27. The controller 49 is preferably some type of logic device, such as a microcomputer chip, an ASIC, a programmable logic controller (PLC), or other similar device. Of course, the flipper module controller 49 can be a part of the overall controller 23 of the media handling device 13. In the exemplary embodiment 27, the controller 49 is merely a portion of the logic (software and/or firmware) that is programmed into the overall controller 23 for the media handling device 13. Depending on the application of the exemplary embodiment 27, the flipper controller 49 may be implemented into a totally separate logic device.

The motor 28 is operated by a driver 44. The driver 44 supplies power to the motor through a driver cord 46. The driver 44 is connected through a power cord 48 to a power supply 47. As with the flipper controller 49, the power supply 47 for the DC motor 28 may merely comprise the general power supply 24 that supplies power to the media handling device 13. Of course, the motor 28 can be equipped with a separate power supply 47 depending on the application of the flipper module 17. In the exemplary embodiment 27, the power for the driver 44, and consequently the motor 28, is derived from the power supply 24 of the media handling device 13. Thus, the power supply for the flipper module 47 depicted in FIG. 2 is the same as the power supply for the paper handling device 24, depicted in FIG. 1B.

While the DC motor 28 is driven by the driver 44, the driver 44 is directed to supply a specific current and voltage of power to the motor 28 by the controller 49 through a control line 51. The controller 49 bases its instructions to the driver 44 on the results of a control algorithm programmed into the controller 49. The controller 49 adjusts the motor speed based on a series of preset values and on the actual current speed of the motor 28, as indicated by the feedback received from the encoder 41.

The basic operation of the exemplary embodiment 27 will now be described. In describing the operation of the exemplary embodiment 27, a exemplary embodiment for a control algorithm 60 (see FIGS. 3–5) to be used in the controller 49 of the exemplary embodiment 27 will also be described.

Figure 3:
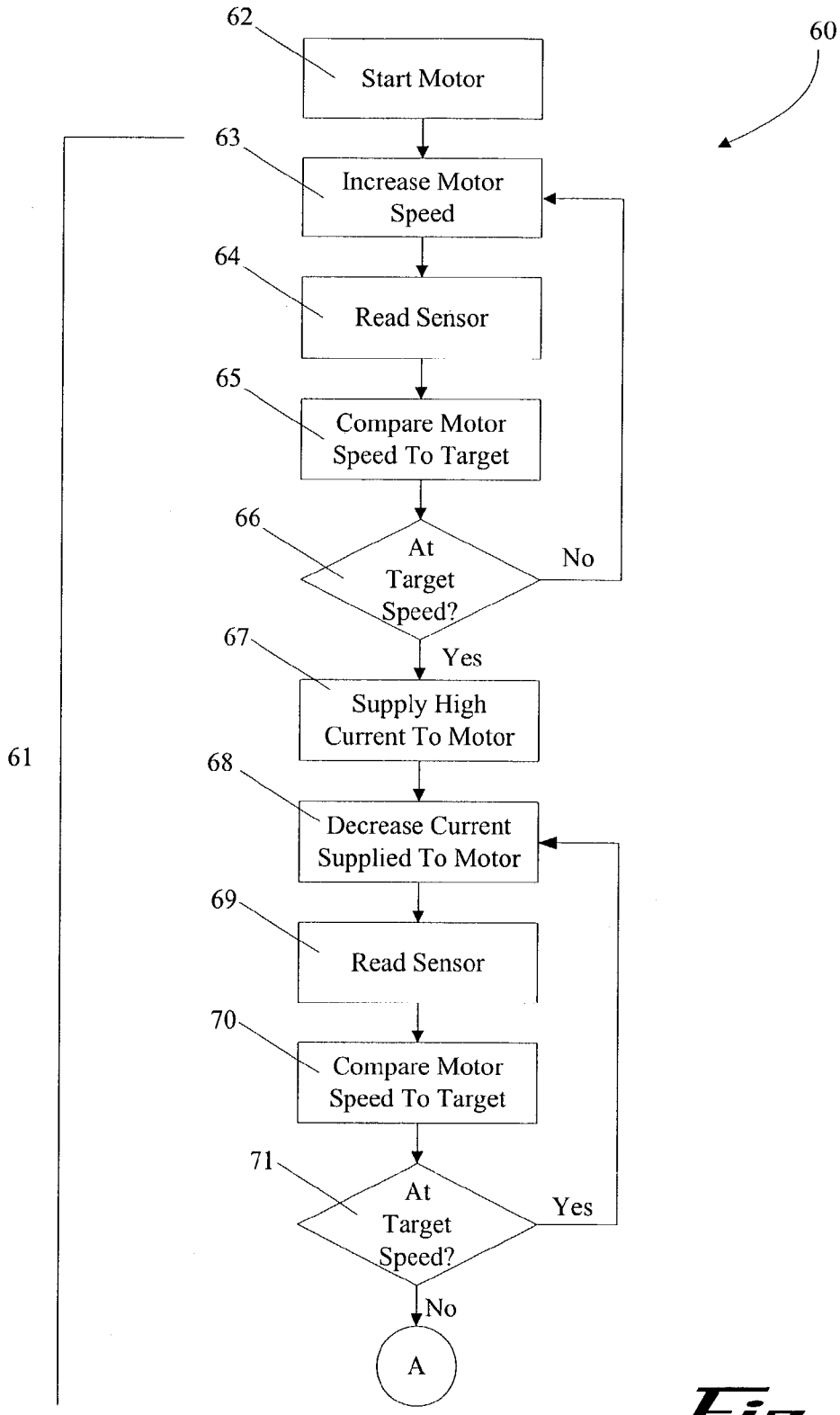
FIG. 3 is the first portion of a flow chart of an embodiment of a control algorithm used with relation to the flipper assembly of FIG. 2.
Figure 4:
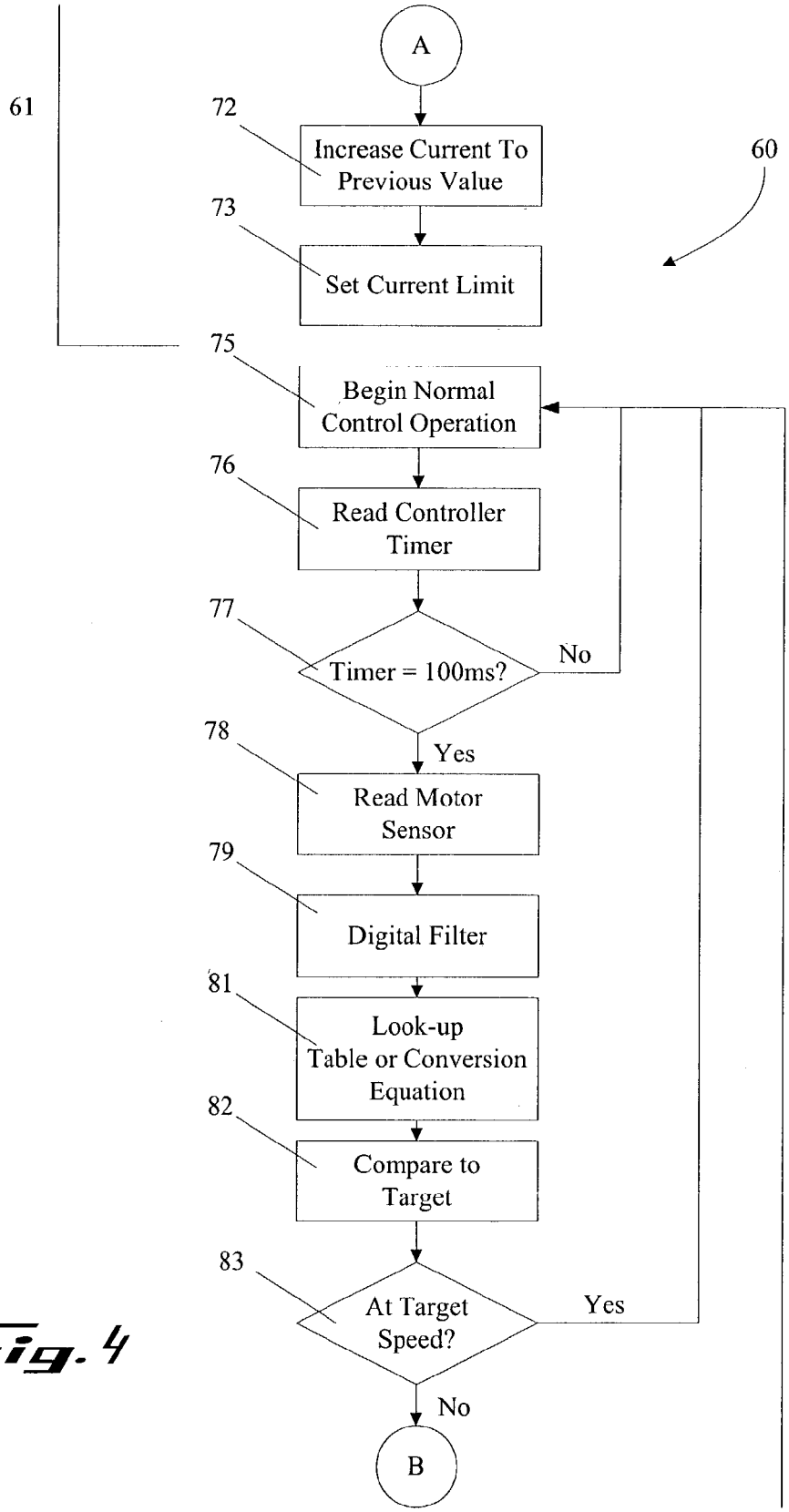
FIG. 4 is a continuation of the flow chart of FIG. 3.
Figure 5:
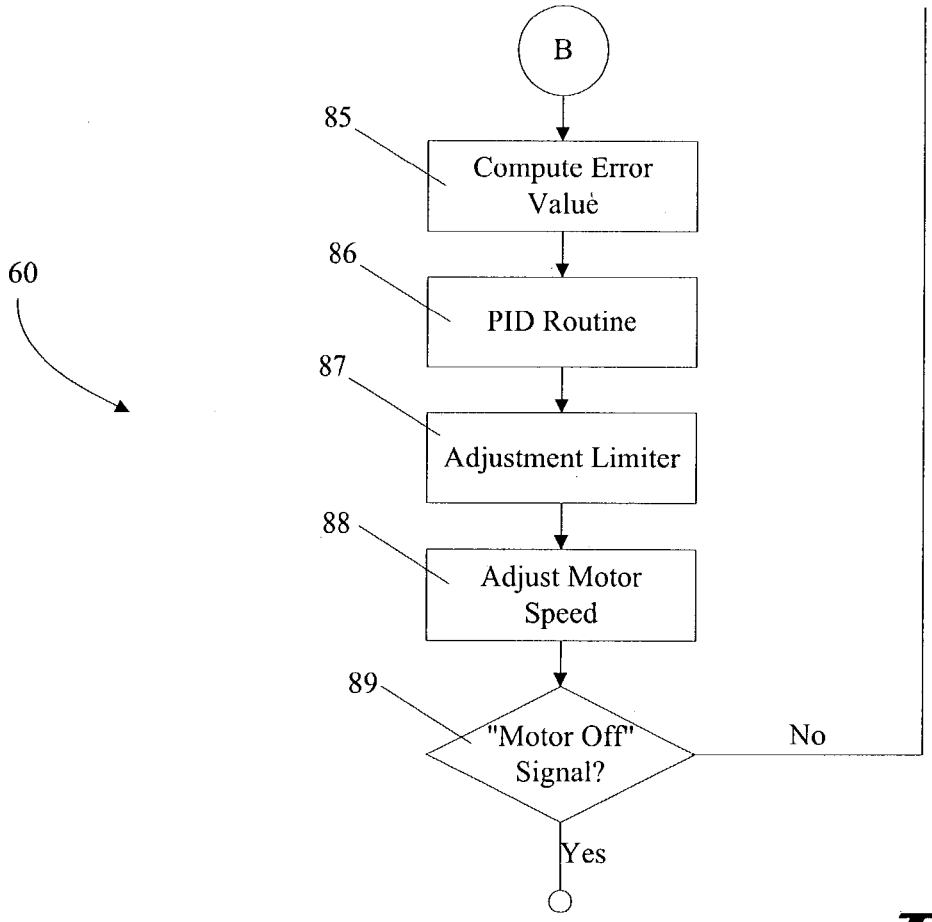
FIG. 5 is a continuation of the flow chart FIG. 4.

Note that the flow chart of FIGS. 3–5 shows the architecture, functionality, and operation of a possible implementation of the flipper module control software. In this regard, each block represents a module, segment, or portion of code, which comprises one or more executable instructions for implementing the specified logical function(s). It should also be noted that in some alternative implementations, the functions noted in the blocks may occur out of the order noted in FIGS. 3–5. For example, two blocks shown in succession in FIGS. 3–5 may in fact be executed substantially concurrently or the blocks may sometimes be executed in the reverse order, depending upon the functionality involved, as will be further clarified hereinbelow.

When the media handling device 13 is powered up, power is supplied to the flipper module 17 and the controller 49 begins executing the control algorithm 60. The first phase of the control algorithm 60 is an initialization routine 61. In the initialization routine 61, the control algorithm 60 issues an instruction to the driver 44 to start the DC motor 28 (Block 62) and then increase the speed (Block 63) of the flipper motor 28 incrementally. The controller 49 monitors the speed of the motor 28 through the feedback 52 of the encoder 41 (Block 64). The controller 49 is pre-programmed with a target motor speed and upon receiving data on the speed of the DC motor 28 from the encoder 41, compares the actual speed of the DC motor 28 to the target speed (Block 65). The controller 49 does not need to compare every signal sent from the encoder 41 to the target speed. Rather, the controller 49 preferably samples the speed by means of a timer so that the comparison occurs every certain number of milliseconds. The time between samples is commonly known as the "sampling period."

As shown in Block 66, if the actual speed of the motor 28 is less than the target speed, the controller 49 instructs the driver 44 to continue increasing the speed of the motor 28. The speed of the motor 28 is controlled by adjusting the voltage supplied to the motor 28. That is, if additional speed is desired, the driver 44 increases the voltage supplied to the motor 28. If the actual speed of the motor 28 is equal to the target speed, the algorithm 60 continues and does not instruct the driver 44 to increment the speed of the DC motor 28.

Once the speed of the motor 28 is established, the initialization routine 61 then adjusts the torque of the motor 28. In some embodiments, the algorithm to adjust the torque of the motor 28, as will be described below, can be operated in parallel to the speed adjustment routine discussed above. However, in the exemplary embodiment, the motor speed is established first, before the algorithm begins setting the appropriate motor torque.

The driver 44 preferably has the capability to adjust the current, as well as the voltage, supplied to the motor 28 during operation. Adjusting the current supplied to the motor 28 adjusts the torque that the motor 28 exerts on a sheet of material 38 traveling through the flipper module 17. The primary object of this portion of the initialization routine 61 is to set a maximum current that will be applied to the motor 28 during operation. This maximum current, or course, translates into a maximum torque that the motor will apply to sheet material 38 handled by the flipper module 17. Since one objective during normal operation of the flipper module is not to pull a sheet of material 38 away from the imaging device 11 prematurely, the maximum current level is preferably set prior to moving sheet material 38 through the imaging device 11. As will be understood by one with ordinary skill in the art, the maximum current will depend not only on the particular motor 28 used, but also on the particular imaging device 111 and flipper rollers 37*a*, 37*b* used.

In operation, the current adjustment routine begins by supplying the motor 28 with a very high current (Block 67). This level of initial current will largely depend on the specific motor 28 used in the exemplary embodiment 27. Then, the driver 44 is instructed by the initialization routine 61 to gradually lower the current supplied to the motor 28 (Block 68). Preferably, the driver 44 reduces the amount of current supplied by a set, arbitrary, small amount ($Delta_1$) every certain number of milliseconds (for example, every 20 milliseconds (ms). After the current is reduced, during the 20 ms delay, the routine checks the speed of the motor 28 (Block 69) and compares the motor speed to the target speed (Block 70). If the speed of the motor 28 drops below the target speed, then the routine is completed. However, if the speed of the motor 28 remains constant at the target seed, the routine continues and the driver 44 will further reduce the amount of current supplied to the motor 28 (Block 71).

When the speed of the motor 28 falls below the target speed value, this means that the current supplied to the motor 28 is inadequate to keep the motor 28 operating at the target speed. The initialization routine 61 then increases the current supplied to the motor 28 back to the previous current value by adding $Delta_1$ to the current (Block 72). This level of current is the minimum current needed to move the system with no sheet material 38 in the system (just the rollers 37*a*, 37*b*). This level of current can be referred to as "$I_{min}$."

$I_{min}$ current will not supply enough torque to the motor 28 to start the motor 28 and to move sheet material 38 though the exemplary embodiment 27 during operation. For normal operation, the initialization routine 61 of the exemplary embodiment 27 increases the current supplied to the motor 28 by an amount ($Delta_2$) such that the current supplied is equal to: $I_{min}$+$Delta_2$. This current value can be referred to as the "Current Limit." The current limit is the maximum current that will be used during operation of the preferred embodiment 27. The Current Limit also represents the torque limit of the motor 28 during operation. (Block 73)

The amount that the minimum current ($I_{min}$) is increased ($Delta_2$) is a value that is easily determined experimentally by one with ordinary skill in the art. The torque exerted by the motor 28 under the Current Limit is preferably enough torque to start the motor 28, turn the rollers 37*a*, 37*b*, and transport sheet material 38 though the flipper module 17 during operation. Thus, one can, through experiment, determine the appropriate value of $Delta_2$ to yield the appropriate Current Limit. In the exemplary embodiment 27, the Current Limit is preferably not so much current that a piece of sheet material 38 is pulled from the imaging device 11 during operation of the flipper module 17.

Once the speed of the motor 28 and toque of the motor 28 are set, the initialization routine 61 is completed. Basically, this initialization routine 61 is a calibration procedure for the flipper module 17 of the exemplary embodiment 27. In the exemplary embodiment 27, this calibration procedure is exemplary only performed one time. In the current implementations of a flipper module with a stepper motor, similar calibration procedures are required between every sheet of material handled by the flipper module. The fact that the exemplary embodiment 27 only runs an initialization routine 61 one time greatly increases the speed at which a flipper module 17 can operate over a similar flipper module having a stepper motor.

Once the torque is set in the initialization routine 61, the torque preferably remains at this level for the remainder of the operation of the exemplary embodiment 27. Any adjustments to the motor 28 are preferably effected though adjustments to the voltage supplied to the motor 28.

Once the DC motor 28 has reached a steady-state speed value equal to the target speed, and an appropriate toque has been set, operation of the flipper module 17 can begin (Block 75). Initially, the exemplary embodiment of the flipper controller 49 is equipped with a system timer, or system clock. This can, optionally, be a system clock for the paper handling device controller 23. Regardless, the algorithm 60 for controlling the flipper module 17 begins normal operation by reading the timer (Block 76) and recording an initial timer value. Then, the algorithm 60 begins comparing the current timer value to the initial timer value. If the difference between these two timer values is less than 100 ms, the algorithm 60 continues to check the timer and compare the timer values. Only after the difference between the initial timer value and the current timer value is greater than or equal to 100 ms is the algorithm 60 permitted to proceed (block 77).

After the appropriate timer value is reached, the algorithm 60 initiates a read routine. With a DC motor 28, a read routine is not necessary but once every 100 milliseconds, or even longer in some embodiments. This is yet another advantage to using a DC motor as opposed to a stepper motor. Optionally, the delay can be fine-tuned in the run of the routine 60 based on the individual parameters of the system at hand. Thus, the read routine could be run more frequently than once every 100 milliseconds, or less frequently, as desired. One would be able to determine the appropriate delay for a given system based on experience and/or experimentation. However, with the example environment 10, and the example media handling device 13, once every 100 ms is sufficient.

When the timer reaches its threshold, the algorithm 60 begins the read routine by reading the number of pulses emitted by the encoder 41 per second (Block 78). This input is then run through a digital filter (Block 79) in order to filter out noise in the system. The filtered data is compared to a look-up table for the encoder 41 to arrive at the speed of the motor 28 (Block 81).

The algorithm 60 is equipped with a target motor speed based on the torque and acceleration desired for the sheet material. As noted above, the data from the encoder 41 is converted to a motor speed (Block 81) and this value is compared to the target motor speed value (Block 82). If the speed of the motor 28 equals the target (Block 83), no speed adjustment is necessary and the algorithm 60 returns to the timer routine. However, if the speed of the motor 28 is not equal to the desired target speed, the algorithm initiates an adjustment routine 84.

The target speed is computed from a knowledge of the speed at which the sheet material 38 is desired to be moved (300 m/s in the above example). Knowing this speed and the gear ratio, one with ordinary skill can easily compute the target motor speed.

The adjustment routine begins by taking the difference between the target speed and the actual speed (Block 85). This difference can be seen as an error value. This error value is then transferred to a PID (proportional-integral-derivative) controller routine (Block 86). Generally described, the PID controller routine preferably computes a change in motor speed based on the error value using the following formula: $(Kd*d\Delta S/dt)+(Ki*\int\Delta Sdt)+Kp*\Delta S$. In the formula, Kd, Ki, and Kp are constant values, or "gains." The term $\Delta S$ reflects the error value; $d\Delta S/dt$ is the derivative with respect to time of the error value; and $\int\Delta Sdt$ is the integral with respect to time of the error value. Therefore, the constant Kp can be viewed as a proportional gain; Kd as a derivative gain; and Ki as an integral gain. The PID equation above can take many forms, and other error correction algorithms can be used.

As mentioned above, the output of the PID control routine is an adjustment value for the flipper motor 28. This adjustment value reflects the amount the motor speed should be increased or decreased in order to move the speed of the motor 28 back to the target value. The adjustment value is then inputted into a limiting routine (Block 87) so that the speed of the motor 28 will not be dropped below a certain threshold, or increased above a certain threshold. If the adjustment value is between pre-set limits for the motor speed, the speed of the motor 28 is adjusted (Block 88) by the adjustment amount. This adjustment is preferably accomplished by the controller 49 altering the amount of voltage sent to the motor 28. The proper amount of voltage is typically obtained from a look-up table in the controller 49. Once the motor speed is adjusted the adjustment routine concludes and the algorithm 60 continues along its path.

At the end of the algorithm 60, the algorithm 60 checks to see if a motor-off signal has been generated by the user (Block 89). If no off signal is detected, the algorithm 60 returns to the timer routine. Of course, if an off signal is detected, the motor 28 is shut off by the algorithm 60.

The control algorithm can be implemented in hardware, software, firmware, or a combination thereof. In the some embodiments, the control algorithm is implemented in software or firmware that is stored in a memory and that is executed by a suitable instruction execution system. If implemented in hardware, as in an alternative embodiment, the control system can be implemented with any of a combination of the following technologies, which are all well known in the art: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), etc.

The control algorithm, which comprises an ordered listing of executable instructions for implementing logical functions, can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can contain, store, communicate, propagate, or transport the program for use by or in connection with the instruction execution system, apparatus, or device. The computer-readable medium can be, for example but not limited to, an electronic, magnetic, optical, electromagnetic, infrared, or semiconductor system, apparatus, device, or propagation medium. More specific examples (a nonexhaustive list) of the computer-readable medium would include the following: an electrical connection (electronic) having one or more wires, a portable computer diskette (magnetic), a random access memory (RAM) (electronic), a read-only memory (ROM) (electronic), an erasable programmable read-only memory (EPROM or Flash memory) (electronic), an optical fiber (optical), and a portable compact disc read-only memory (CDROM) (optical). Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory.

The invention claimed is:

1. A system for handling a sheet material, said system comprising:

a shaft for accelerating a sheet material; and a drive system for causing said shaft to rotate, said drive system having a direct current motor configured to drive said shaft, wherein said drive system further comprises:

an encoder associated with said direct current motor for collecting information regarding a speed of said direct current motor;

a controller for receiving the information from said encoder, and for executing an algorithm for affecting the operation of said direct current motor; and a driver for distributing power to said direct current motor based on input from said controller, wherein the driver controls a supply of electrical current to the motor to control torque applied to the sheet, wherein the controller is configured to determine a minimum current that may be supplied to the motor at which torque from the motor moves the shaft at a target speed.

2. The system of claim 1, wherein the controller is configured to determine the minimum current by sensing a speed of the motor and decrementally adjusting the level of current supplied to the motor until sensing a change in the speed of the motor from at or above a target speed to below the target speed.

3. The system of claim 1, wherein said shaft and said drive system are included in a flipper device, further wherein said flipper device is housed in a media handling device disposed adjacent to an imaging device.

4. The system of claim 1, wherein said sheet material comprises paper.

5. The system of claim 4, wherein said shaft includes a frictional member configured such that said shaft accelerates said paper by contact between said frictional member and said paper.

6. The system of claim 1, wherein said algorithm is configured to receive the information from said encoder, compute an error value corresponding to the difference between an actual speed of said motor and a target speed of said motor, and adjust the speed of said motor by an amount corresponding to the output of a Proportional-Integrated-Derivative feedback control system which uses the computed error value.

7. The system of claim 6, wherein said motor speed is adjusted by the algorithm by controlling the voltage supplied to said motor.

8. The system of claim 7, wherein said system is used in conjunction with a computer printer device such that the sheet material is received by said shaft from the computer printer device.

9. The system of claim 2, wherein the controller is configured such that the decremental adjusting of the level of current is performed in a stepwise manner.

10. The system of claim 2, wherein the controller is configured to determine the minimum current by additionally incrementally adjusting the level of current supplied to the motor after sensing the change in the speed of the motor from at or above the target speed to below the target speed.

11. The system of claim 1, wherein the driver is configured to supply an initial level of current to the motor and wherein the initial level of current supplied to the motor is greater than the determined minimum current.

12. A paper handling system for accelerating a sheet material comprising:

means for applying a force on the sheet material;

a direct current motor connected to said applying means, said direct current motor permitting said applying means to cause the sheet material to move;

means for providing feedback data on a speed of said direct current motor; and means for controlling said direct current motor responsive to said feedback means, said controlling means adjusting an electrical current supplied to said direct current motor to maintain a level of torque applied to the sheet material, wherein the means for controlling is configured to determine a minimum current that may be supplied to the motor at which torque from the motor moves the means for applying force at a target speed.

13. The system of claim 12, wherein said applying means comprises a shaft having a frictional member in contact with the sheet material to be moved.

14. The system of claim 12, wherein the controlling means is configured to determine the minimum current by sensing a speed of the motor and decrementally adjusting the level of current supplied to the motor until sensing a change in the speed of the motor from at or above a target speed to below the target speed.

15. The system of claim 14, wherein said controlling means adjusts a current supplied to said motor such that the current is at or between a predetermined minimum value and a predetermined maximum.

16. A method for accelerating a sheet material, comprising:

determining a minimum current that may be supplied to a direct current motor at which torque from the motor moves an urging shaft at a target speed;

receiving a sheet material at the urging shaft;

accelerating the sheet material through contact with the urging shaft to a speed corresponding to a speed of the direct current motor;

monitoring the speed of the direct current motor; and adjusting the speed of the direct current motor in order to maintain an approximately constant torque applied to the sheet material.

17. The method of claim 16, wherein the minimum torque is determined by sensing a speed of the motor and decrementally adjusting the level of current supplied to the motor until sensing a change in the speed of the motor from at or above a target speed to below the target speed.

18. The method of claim 17, wherein said adjusting comprises:

receiving the information regarding the speed of the direct current motor sent from the encoder to the controller;

computing an error value by comparing the speed of the direct current motor to a target speed; and computing an adjustment that must be made to the speed of the direct current motor in order to minimize the error value.

19. The method of claim 18, wherein said adjustment computing comprises:

using a Proportional-Integral-Derivative equation to generate a first adjustment value as a function of the error value;

computing a second adjustment value corresponding to an amount of change in voltage to the motor based in the first adjustment value; and causing the voltage sent to the direct current motor to be modified by an amount corresponding to the second adjustment value.

20. The method of claim 19, wherein said Proportional-Integral-Derivative equation is of the form $(Kd*d\Delta S/dt)+(Ki*\int\Delta Sdt)+KP*\Delta S$, where Kd, Ki, and Kp are constants, $\Delta S$ is the error value, $d\Delta S/dt$ is the derivative with respect to time of the error value, and $\int\Delta Sdt$ is the integral with respect to time of the error value.

21. The method of claim 17, wherein the level of current supplied to the motor is adjusted in a step-wise-manner.

22. The method of claim 17, wherein the minimum current is determined by additionally incrementally adjusting the level of current supplied to the motor after sensing the change in the speed of the motor from at or above the target speed to below the target speed.

23. A sheet handling system comprising:

a frictional member configured to contact a sheet;

a direct current motor operably coupled to the frictional member to drive the frictional member;

a sensor configured to sense movement of the frictional member;

a controller configured to generate control signals based at least upon a sensed movement of the frictional member; and a driver configured to selectively adjust a supply of current to the motor in response to the control signals, wherein the controller is configured to generate the control signals such that the driver supplies a level of current greater than or equal to a predetermined minimum current that may be supplied to the motor at which torque from the motor moves the frictional member at a target speed.

24. The system of claim 23, wherein the controller is configured to generate the control signals such that the driver supplies a level of current less than or equal to a predetermined maximum current.

25. The system of claim 24, wherein the frictional member is configured to receive a sheet from an imaging device and wherein the maximum current is such that torque from the motor is less than a level of torque that would result in the sheet being pulled from the imaging device.

26. A method comprising:

frictionally engaging a sheet with a member; and selectively controlling a level of current supplied to a direct current motor to control a level of torque supplied to the member by the motor, wherein the current supplied to the direct current motor is between or at a predetermined minimum value and a predetermined maximum value, wherein the predetermined minimum value of the current supplied to the direct current motor corresponds to a minimum current at which torque from the motor moves the member at a target speed and wherein the maximum current corresponds to a level of current at which torque from the motor is less than a level of torque that would result in a sheet being pulled from a preceding imaging device.

27. The method of claim 26, wherein the minimum torque is determined by sensing a speed of the motor and decrementally adjusting the level of current supplied to the motor until sensing a change in the speed of the motor from at or above a target speed to below the target speed.

* * * * *

UNITED STATES PATENT AND TRADEMARK OFFICE

CERTIFICATE OF CORRECTION

PATENT NO. : 7,183,730 B2
APPLICATION NO. : 10/438399
DATED : February 27, 2007
INVENTOR(S) : Hernan I. Gutierrez Vazquez et al.

It is certified that error appears in the above-identified patent and that said Letters Patent is hereby corrected as shown below:

In column 3, line 6, after "device" delete "111" and insert -- 11 --, therefor.

In column 7, line 51, after "device" delete "111" and insert -- 11 --, therefor.

In column 11, line 45, in Claim 9, delete "stepwise" and insert -- step-wise --, therefor.

In column 12, line 57, in Claim 20, delete "$(Ki^* \int \Delta Sdt)+KP^* \Delta S$" and insert -- $(Ki^* \int \Delta Sdt)+Kp^*\Delta S$ --, therefor.

Signed and Sealed this

Eleventh Day of November, 2008

JON W. DUDAS
*Director of the United States Patent and Trademark Office*